US010465486B1

(12) United States Patent
Lubrecht et al.

(10) Patent No.: US 10,465,486 B1
(45) Date of Patent: Nov. 5, 2019

(54) WELL SCREEN WITH INTEGRATED FILTER OR TREATMENT MEDIA

(71) Applicants: Michael D. Lubrecht, Monroe, WA (US); James M. Doesburg, Gig Harbor, WA (US); Daniel W. Ombalski, Julian, PA (US)

(72) Inventors: Michael D. Lubrecht, Monroe, WA (US); James M. Doesburg, Gig Harbor, WA (US); Daniel W. Ombalski, Julian, PA (US)

(73) Assignee: ELLINGSON DRAINAGE, INC., West Concord, MN (US)

( * ) Notice: Subject to any disclaimer, the term of this patent is extended or adjusted under 35 U.S.C. 154(b) by 584 days.

(21) Appl. No.: 14/887,137

(22) Filed: Oct. 19, 2015

Related U.S. Application Data

(60) Provisional application No. 62/065,746, filed on Oct. 19, 2014.

(51) Int. Cl.
*E21B 43/08* (2006.01)
*E21B 33/128* (2006.01)

(52) U.S. Cl.
CPC ..... *E21B 43/084* (2013.01); *E21B 33/128* (2013.01); *E21B 43/082* (2013.01)

(58) Field of Classification Search
CPC ..... E21B 33/128; E21B 43/08; E21B 43/082; E21B 43/084
See application file for complete search history.

(56) References Cited

U.S. PATENT DOCUMENTS 4,883,589 A * 11/1989 Konon ..... B01D 17/0202 210/140
5,901,789 A * 5/1999 Donnelly ..... E21B 43/04 166/207
6,390,192 B2 * 5/2002 Doesburg ..... E03B 3/20 166/230
6,581,682 B1 * 6/2003 Parent ..... E21B 33/1243 166/119
2007/0256834 A1 * 11/2007 Hopkins ..... E21B 43/082 166/278
2011/0198084 A1 * 8/2011 Lockhart ..... E21B 33/138 166/303
2014/0326447 A1 * 11/2014 Fermaniuk ..... E21B 43/086 166/227
2015/0315880 A1 * 11/2015 Russell ..... E21B 43/082 166/381
2015/0375144 A1 * 12/2015 Greci ..... E21B 43/08 29/896.61

* cited by examiner

*Primary Examiner* — Robert E Fuller
*Assistant Examiner* — Christopher J Sebesta
(74) *Attorney, Agent, or Firm* — Paul B. Heynssens Attorney at Law PLC

(57) ABSTRACT

An improved well screen with an integrated filter or treatment media assembly. An integrated assembly for use in horizontal well installations in which the well screen may be installed without special procedures, and without necessitating the use of a sand pack. An inner extrusion supports a textile sock that may include reactive material. The material is protected by an outer well screen.

18 Claims, 8 Drawing Sheets

Schematic Cross-Section
of Improved Well Screen with
Integrated Filter or Treatment
Media 202

Example Dimensioned Cross-Section
EnviroFlex Inner Pipe Extrusion
306

Process for assembling Improved Well Screen with Integrated Filter or Treatment Media

WELL SCREEN WITH INTEGRATED FILTER OR TREATMENT MEDIA

CROSS REFERENCE TO RELATED APPLICATION

This application claims the benefit of U.S. Provisional Patent Application No. 62/065,746 filed Oct. 19, 2014, the contents of which are hereby incorporated by reference.

TECHNICAL FIELD

This description relates generally to well drilling and more specifically to components of an installed horizontal well.

BACKGROUND

Directional boring, commonly called horizontal directional drilling is a steerable trenchless method of installing underground pipes, conduits and cables, well screens or the like in a shallow arc, underground typically along a prescribed bore path by using a surface launched drilling rig. Pipes laid, or well casing installed in this manner can be made of materials such as iron, steel, PVC, polyethylene, polypropylene, or the like. With this type of drilling there is typically minimal impact on the surrounding area compared to using a trencher or other trench-based installation methods. Directional boring can often be used when trenching or excavating is not practical, such as under roadways, or other existing structures, or at greater depths than it is possible to trench. It is suitable for a variety of soil conditions and jobs that may include road, landscape, environmental remediation and monitoring or water production well applications.

The use of horizontal or directionally drilled wells has become widespread for treatment of contaminated soil or groundwater, construction dewatering, drainage, and water production. In many situations, horizontal wells have advantages over vertical wells for these purposes. For construction dewatering or drainage, horizontal wells can provide extended coverage with very little impact on surface operations, compared to comparable networks of vertical wells. For groundwater production, horizontal wells can capture groundwater from thin or sinuous aquifers that are difficult to tap with vertical wells. For the treatment of contaminated soil or groundwater, horizontal wells offer the advantages of access beneath surface obstructions, such as buildings or sensitive wetlands that would prevent the installation of vertical wells to treat the area. Other advantages also exist.

In installing horizontal and vertical wells, at the end of the bore the well casing extends into a zone that allows liquid, such as groundwater, to be collected and enter the well. Typically a structure is provided that tends to allow the liquid in the surrounding ground to flow into the well bore, without the flow causing the bore to clog. The structure also tends to aid in the flow of fluid into the bore, effectively increasing the flow coming out of the well.

Part of the structure at the end of the bore is a sand pack. One disadvantage of horizontal wells has been the difficulty in the construction of a traditional "sand pack" surrounding the well screen in the horizontal well, as the techniques used in a vertical well causes problems when applied to a vertical well.

FIG. 1 shows a conventional vertical well 100. In a vertical well a screen 112 may be used to keep large particles out of the well pipe, pump, and to prevent clogging of the well pipe 114.

The well screen, which is commonly constructed of carbon or stainless steel, Poly Vinyl Chloride (PVC), High Density Polyethylene (HDPE), or other material provides the component through which water enters the well. During installation the well screen may be suspended in a vertical boring 116 which is of a larger diameter than the screen. The space between the screen and the walls of the bore, known as the well annulus, may be backfilled with sand or gravel 110 during the construction of the well.

Upon development of the well by pumping or other techniques, fine material is washed by liquid 108 from the granular backfill and a graded sand pack is formed through the washing action 118. The sand pack 110 typically includes coarser material adjacent to the well screen, grading to finer material near the wall of the boring. Proper sizing of the well screen slots or perforations, combined with proper selection of the appropriate mesh size of the backfill granular material, results in well that does not entrain fine clay, silt, or sand into the well after development is completed.

The completion of a sand pack, as described for a vertical well, relies on gravity to place the granular backfill. The well screen is held at a central position within the bore using centralizers or some similar mechanism 120.

A centralizer 120 is a device that may include three or more spring-steel protrusions that can be clamped to the well screen as it is lowered into the vertical bore. The centralizers contact the borehole and hold the well screen in the center of the bore. The granular backfill (appropriately sized sand) is then simply distributed evenly around the well screen until it covers the screened interval in the well. Bentonite seals and/or plugs may then be installed past the fill line in the bore 122, followed by a grout slurry to the ground surface.

Horizontal wells present a unique problem in providing sufficient filtering that would be provided by a conventional well screen assembly used in a vertical well. For example the use of centralizers in a meandering, horizontal well path is problematic. Also producing a sand pack in a horizontal path, without aid of gravity to direct the sand to the location of the screen is problematic.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present example provides an integrated assembly for use in horizontal well installations in which the well screen may be installed without special procedures, and without necessitating the use of a sand pack. An inner extrusion or grooved pipe supports a textile sock that may include reactive material. The textile or reactive material is protected by an outer well screen, which may also be extruded or machined with internal grooves.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

DETAILED DESCRIPTION

Figure 1:
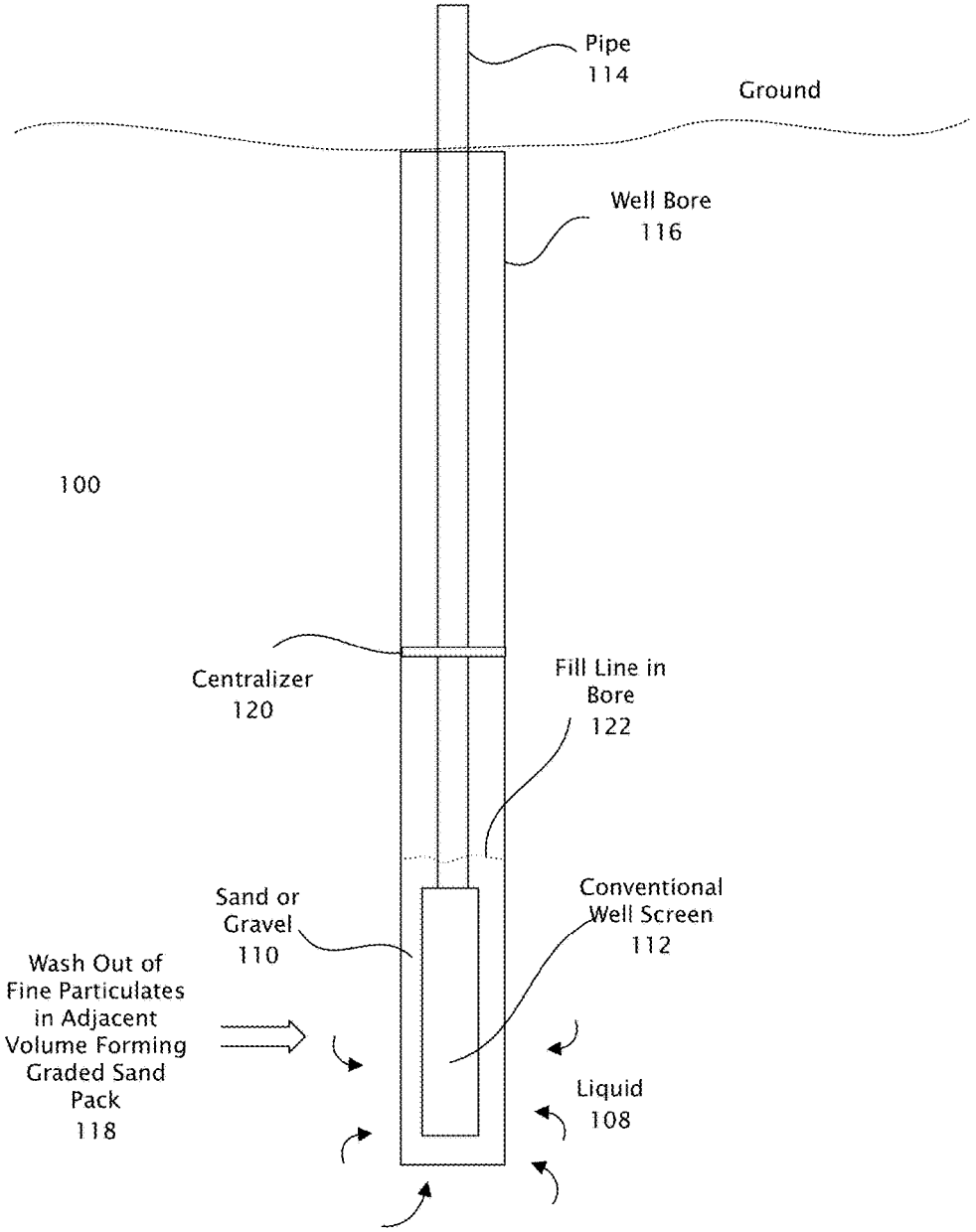
FIG. 1 shows a conventional vertical well.

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

A specially constructed integrated well screen, screen filter and extruded or grooved inner screen as described herein may allow horizontal wells to function better, and also provide improved installation efficiency. As previously stated, in a horizontal well, centralizers and sand packs cannot be installed as described for a vertical well for several reasons.

First the use of centralizers may be problematic. The well screen cannot be practically centralized in a horizontal bore. Most horizontal wells extend for a considerable distance compared to vertical wells. Conventional centralizers are not robust enough to survive the installation of the well screen in a well bore that has one or more bends in the well path, as is commonly the case with horizontal wells. The centralizers are either damaged during the installation process or can cause the well casing and screen to jam in the bore during installation, preventing the completion of the well.

Further with respect to centralizers, the number of centralizers required to elevate the well screen off the lower part of the bore would be excessive. In a vertical well, centralizers may only be required at intervals of 20 feet or so to centralize the pipe. In a horizontal bore, the weight of the pipe compresses the spring steel of the centralizer, with the result that no amount of them may be sufficient to elevate the pipe. Hence, it becomes impossible to construct a concentric sand pack completely surrounding the well screen.

The second difficulty in producing a sand pack, is the placement of the granular backfill itself. In a vertical well, simply shoveling the sand into the top of the borehole is sufficient for placement. Gravity causes the sand to fall into position at the bottom of the well. In a horizontal well, gravity does not provide this assistance, so the sand must be injected as a slurry or through some other method. Any effective method for placing the sand requires that a tremie pipe (a small diameter pipe placed temporarily in the well to enable the precision placement of sand, grout, etc.—it is withdrawn as the material is placed) be inserted into the well to the desired depth. However, the centralizers that are required to elevate the pipe prevent placement of the tremie pipe.

Construction of a traditional sand pack has typically proved unsatisfactory in horizontal well installation techniques. The complexity of the process and low rate of success eventually caused this method to be abandoned as filtration typically could not be achieved in an installed well.

Subsequent attempts to provide some manner of filtration in a horizontal well included wrapping the well screen with a fabric such as a geotextile prior to its installation in the bore. A geotextile is a fabric material, typically composed of polyethylene or other synthetic material which contains a plurality of engineered pores or openings created through the manufacturing process. The openings correspond to standard soil sieve sizes. Geotextile fabric used in drainage applications is selected on the basis of its opening size, among other factors, to allow the free drainage of water through the textile, while retaining soil particles behind. The geotextile filtration layer was held in place using various devices, such as nylon cable ties, stainless steel band clamps, fiberglass packing tape, and other field expedient methods.

The wrapping method was sometimes successful. But, more often than not the textile would be damaged during installation, leaving gaps in the filter system. Also, the geotextile would tend to bunch up along the pipe in high-friction areas where the pipe negotiated curves in the bore profile, or would snag on subsurface obstacles, causing tears or jamming the well string in the bore. For these reasons, this method of providing a filtration media was also abandoned.

Further attempts to incorporate a filtration system into a horizontal well have included attempts to bond a fine mesh to the external surface of a conventional well screen, or to use a sintered polyethylene material to provide filtration. Both of these products tend to be expensive and thus impractical. These special materials also necessitated special handling and the use of special drilling and installation techniques to prevent damage or destruction of the fragile filtration product.

In the mid 1990's a patent (U.S. Pat. No. 6,390,192) was granted for the invention of a filtration material. This typical sheet material is called ENVIROFLEX™ manufactured by Directed Technologies Drilling, Inc.—3476-B W. Belfair Valley Rd., Bremerton, Wash. 98312 and consists of a filtration layer that is held in place by a substantially rigid but somewhat pliable coarse mesh or lattice, made of high density polyethylene, to which it is bonded. This geocomposite is typically used in earthworks construction as a drainage layer and stabilization material in the construction of roads and highways, as a drainage layer adjacent to building foundations, or as a filtration media in the construction of French drains. It is not constructed or formed for use in well installations, but typically laid in a trench as a sheet and backfilled.

For the manufacture of the improved well screen with ENVIROFLEX™, the material may be cut into strips, formed into tubes, and pulled into a perforated or slotted well screen. The exterior, slotted pipe provides support and protection for the material, which provides the desired filtration. The mesh serves to hold the geotextile sufficiently tightly against the well casing interior wall. The advantages of the uniquely constructed system are relatively low cost, ease of installation without the use of carrier casing or other special requirements, and protection of the filtration media during installation.

The disadvantages of this system (that have been remedied in the examples described below) derives from the flexibility inherent in the inner mesh or lattice layer. During well development and/or pump installation, it is possible to snag tooling, pumps or piping, or electrical connections on the interior mesh and damage the filter system. This can provide an unfiltered open area in the well casing through which particulate matter can enter the well. In other situations, higher pumping rates in larger diameter casing, has caused the mesh and geotextile filter to collapse.

The design of the improved well screen with ENVIROFLEX™ was subsequently modified to include a slotted interior pipe, which is installed inside the geocomposite layer. This further improvement corrects the deficiencies noted above, but has drawbacks as well-especially in its manufacture.

The manufacture of ENVIROFLEX™ is relatively complex, with several challenging aspects:

The geocomposite material is difficult to cut to accurate dimension, due to stretch in the inherently flexible geomesh and fabric, and its resistance to cutting.

During manufacture of the well screen, the geocomposite is formed into a tube, then inserted inside the outer casing. Although various methods have been used in this process, the flexibility of the geocomposite results in gaps in the material which results in areas of no filtration within the completed product.

To prevent gaps, an extra strip of geotextile has been bonded along the seam in the formed geocomposite tube, however the necessary heat or adhesive bonding of this "bandage" strip to the geocomposite tube results in a stripe of lower conductivity along the filter. Also, the use of adhesives, which may contain toxic or volatile chemicals, is not desired in well screens destined for potable water wells or environmental remediation wells.

The available geocomposite materials have a limited commercial selection, with few options available for the apparent opening size (equivalent to mesh size) of the geotextile component.

The available geocomposite material is also lacking in another area. In addition to these operational and manufacturing issues, a recent development in the remediation of contaminated groundwater has been the use of passive treatment methods. Such methods place either a biologically or chemically active material in contact with contaminated groundwater. As the groundwater passes through the treatment media, contaminants are removed or transformed into non-toxic products. No pumps or other electrical or mechanical devices are required for this treatment.

This treatment method is generally called a Permeable Reactive Barrier (PRB), where the reactive materials are incorporated into a vertical slurry wall of a length and depth sufficient to capture and treat a desired volume within a contaminant plume.

Advantageously in the current examples described herein, reactive materials may be incorporated into a horizontal remediation well to treat groundwater at a contaminated site. Such reactive materials may be embedded or infused in a geotextile such as the exemplary ENVIROFLEX™, and may be formed into sheets, or may be encapsulated between two layers of permeable geotextile. Such reactive elements include activated carbon, zero valent iron nano particles, micro-rilled ceramic beads that act as host structures for natural microbe growth, and other materials. Such material is commercially available, with the reactive material sandwiched between two thin layers of geotextile, with the multiple layers then quilted by sewing or heat-bonding.

Reactive materials of this sort are not available in a geocomposite form for incorporation into the original ENVIROFLEX™ design for passive filtration in collection applications such as in passive drains. However, incorporation of reactive materials into a passive treatment well screen may be a desirable application, with a multitude of potential uses for environmental site cleanup. Such a composite material might also be applicable to a horizontal well that is pumped rather than passive in nature (such as a French drain). For the reasons listed above, various improvements to the original design of ENVIROFLEX™ were sought and incorporated into the design of an assembly having a specially constructed integrated well screen, screen filter and extruded or grooved inner screen that does not necessitate special installation techniques, and tends to remove impurities within the well-before fluid is pumped from the well.

The examples below describe a device, system and method for filtering impurities from a horizontal well. Although the present examples are described and illustrated herein as being implemented in a well screen system, the system described is provided as an example and not a limitation. As those skilled in the art will appreciate, the present examples are suitable for application in a variety of different types of active and passive pumping and drainage systems respectively.

Figure 2:
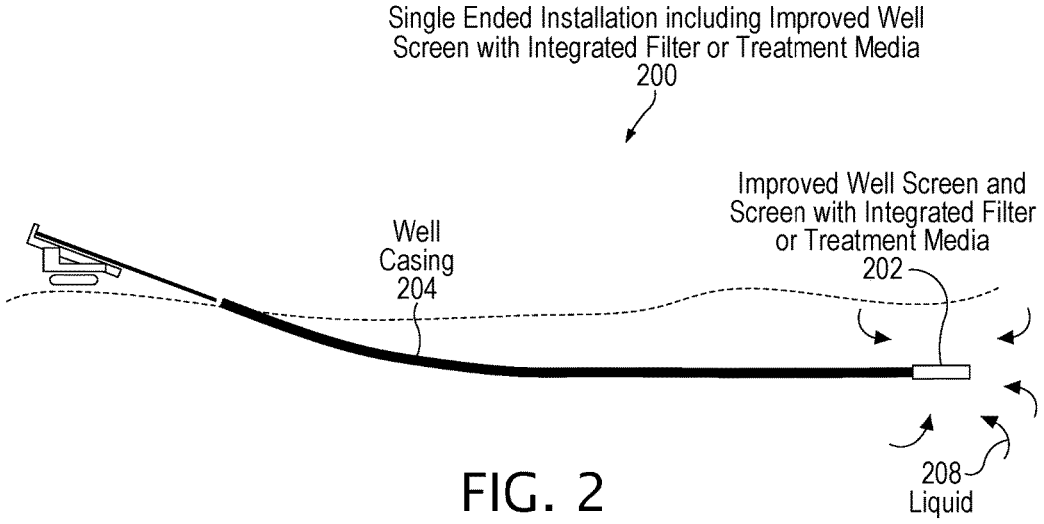
FIG. 2 shows a horizontal well having a specially constructed integrated well screen, screen filter and extruded or grooved inner screen installed at the end of the bore.

FIG. 2 shows a horizontal well having a specially constructed integrated well screen, screen filter and extruded or grooved inner screen installed at the end of a well casing 204 installed in a bore 200. Such a well screen 202 may be economically installed without special procedures, and without the use of a sand pack, and advantageously allows filtration of undesirable materials from liquids 208 prior to removal from the well, typically by pumping, or the like.

Figure 3:
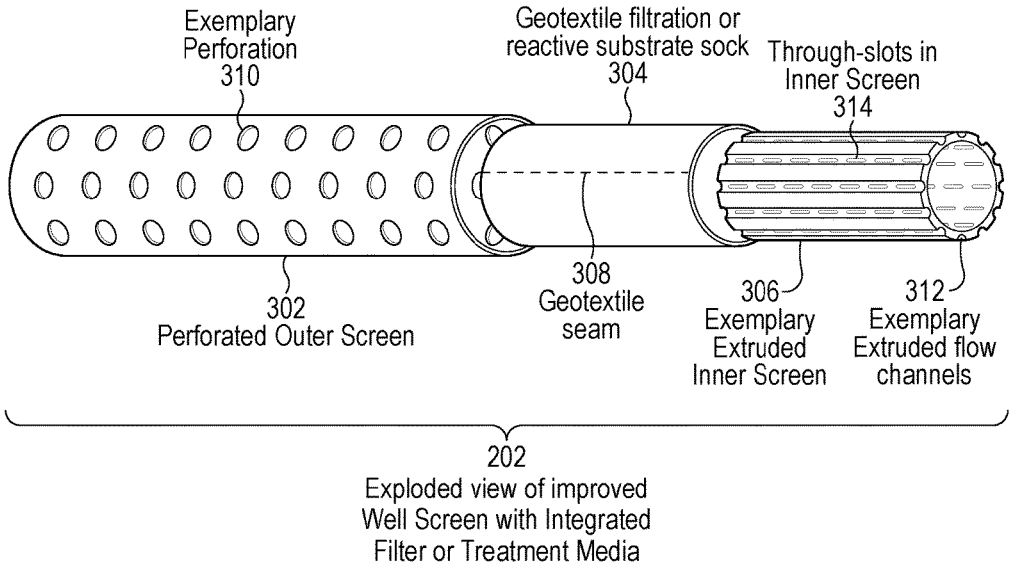
FIG. 3 shows an exploded component view of an example of the specially constructed integrated well screen, screen filter and extruded or grooved inner screen.

FIG. 3 shows an exploded component view of an example of the specially constructed integrated well screen, screen filter and extruded or grooved inner screen 202. The present example is of a well casing (not shown) that includes the illustrated integral integrated well screen and screen filter 202 for use in well installations or for drainage applications and a method for making and using the product. One example includes a well screen 302 with a composite filter 308 placed in the internal volume of the screen 302.

The perforated outer well screen 302 is typically made of high-density polyethylene (HDPE) and may include a plurality of perforations or apertures of various shapes and sizes (exemplary perforation 310) to allow fluid communication or flow, between the inside of the well screen and the outside. The screen 302 can be made of any suitable material, including steel, stainless steel, polyvinyl chloride (PVC), fiberglass, or other commonly used well casing materials. The well screen can be manufactured to any length. To provide more surface area in the filter 304 component, the outer well screen 302 may also be constructed with grooves or flow channels situated around its interior diameter. These may be formed during extrusion of the well screen 302 or may be machined by some other process.

The filter component 304 may be made from a pliable filter material which is formed into a hollow tubular shape typically by sewing, however heat bonding is an alternate method. This tube is then affixed to an extruded or grooved, perforated tubular casing 306 that holds the filter material in contact with the interior wall of the external casing 302. The filter material is typically a non-woven geotextile with the filtration characteristics and chemical resistance properties required for the application, however other equivalent filtration materials can be used. As previously described the sheet material may be joined or seamed 308 to itself to form it into a tube or sock shape 304.

The extruded or grooved, perforated tubular casing 306 holds the filter material 304 in contact with the interior wall of the external screen, or casing 302. In addition to supporting the filter material, the interior perforated tubular casing, or screen 306 protects the filtration material from damage, promotes infiltration of water through the well screen, and eases the installation of pumps, piping, and other down hole tooling during development and operation. The grooves in the casing 306 may be formed during the pipe extrusion process or by any suitable method following or during manufacture of the pipe. The inner screen 306 may include longitudinally formed, or extruded, flow channels 312 formed as grooves on the outer surface of a tubular structure 306. Along the length of the extruded flow channel groves perforations 314, may be disposed in intervals so that fluid flow through the surface of the geotextile sock 304 is provided.

In another alternative example, the filtration material 304 may be replaced by a biologically or chemically active material which is incorporated into sheets or is embedded or encapsulated in layers of geotextile. The active material may be in a variety of forms including prilled or granulated, or may take the form of threads or sheets of material itself. Loose material may be quilted between two sheets of geotextile, which is subsequently formed into a tube. This material is incorporated into a tubular shape with similar size and shape to the filtration material described previously. The reactive material enables the well casing to be used in a passive treatment system for treatment of environmental contamination.

Figure 4:
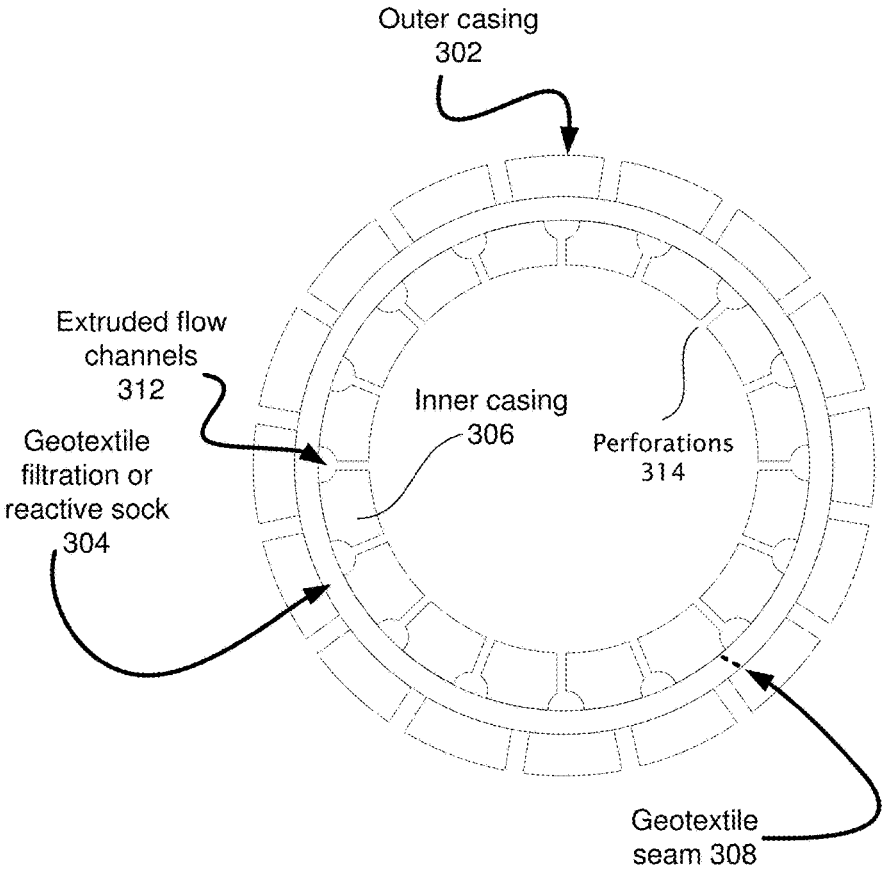
FIG. 4 shows a cross-section of an example of the specially constructed integrated well screen, screen filter and extruded or grooved inner screen.

FIG. 4 shows a cross-section of an example of the specially constructed integrated well screen 302, screen filter 304 and extruded or grooved inner screen 306.

The interior casing 306 is an extrusion that has generally smooth walls on its interior surface, but is fluted or grooved longitudinally at intervals around the exterior circumference. The flutes or grooves may be incorporated as part of the pipe extrusion process, may be machined into the exterior wall of the pipe following extrusion, or formed by any suitable method. The flutes or grooves 312 are generally straight, and parallel with the long axis of the casing. In this instance, the casing is perforated or slotted such that the majority of the perforations are located within the fluted part of the casing exterior.

In addition to these flutes or grooves on the inner casing, at regular intervals along the length of the casing, circumferential grooves (not shown) may be molded or machined into the casing. These may be used in combination with mechanical fasteners such as banding material, or the like, to lock the filtration geotextile in place and prevent movement of the material during manufacture.

An advantage of this interior casing design described herein is the addition of the flutes or longitudinal grooves 312. These groves 312 tend to provide efficient pathways for fluid movement to the interior of the well casing after the fluid has passed through the filtration material 304. In providing these pathways, the potential for plugging of the pore spaces (not shown) in the filter fabric, adjacent to the outer casing perforations, is reduced, since fluids have a greater effective area through which they can migrate as they move towards the well center. The fluted internal casing or screen 306 constructed as described above, tends to eliminate the disadvantages of the bonded geocomposite zone, both in manufacture and in application.

A first example has a well screen with an internal filter, where the filter 304 material (Exemplary ENVIROFLEX™) is fashioned into a tubular form prior to assembly. This may be done by sewing a tube 304 from a strip of the filter material that is cut to the correct width and length to form a circumference that will fit over the inner extruded or grooved tubing 306 and is of the proper length when seamed 308. The tubular form may also be fashioned by heat sealing. adhesive bonding, or equivalent. Another method of forming the tubing 306, would be to manufacture the filter material as a tubular filter sock in a single operation, without the need to build a tube from a flat sheet in a subsequent operation. The interior casing 306 is then inserted in the tubular filter 304 and is secured at regular intervals or is held in place by a friction fit. If the interior casing has circumferential grooves (not shown), the filter is affixed at regular intervals with a mechanical fastener (not shown) that holds the fabric into the groove to prevent the fabric from slipping from position when the filter assembly is inserted into the exterior casing.

A second example has a well screen with an integrated reactive material mat, which is formed into a tube 304 in the same manner as the filter assembly previously described. This example would be employed in the construction of treatment systems with a passive treatment component.

The examples described herein tend to solve several of the problems of the prior art. Unlike the prior art, and because the filter is inside the exterior well screen, filter damage during insertion of the screen into the well bore tends to be eliminated or substantially reduced. Protecting the filter 304 by positioning it on the interior of the well screen tends to prevent damage during well completion and development. The smooth interior surface of the inner casing eases installation of development tools and pumps or piping to complete the well. Further, sewing or bonding the filter into a continuous tube prior to assembly of the well screen tends to prevent gaps in the filter, through which sand or other particles may enter the well.

Finally with respect to the inner screen 306, supporting the filter 304 with a rigid to semi-rigid interior casing tends to prevent distortion or collapse of the filter system under high pumping rates. Putting the filter 304 inside the screen 302 with a thin inner support 306 results in a thinner cross section that allows the screen to bend easily when it goes around corners in well bores. The configuration also allows better tailoring of the stiffness of the combination to the application, has excellent hydraulic performance, is more durable, and costs half as much as present screened filter casings.

Figure 5:
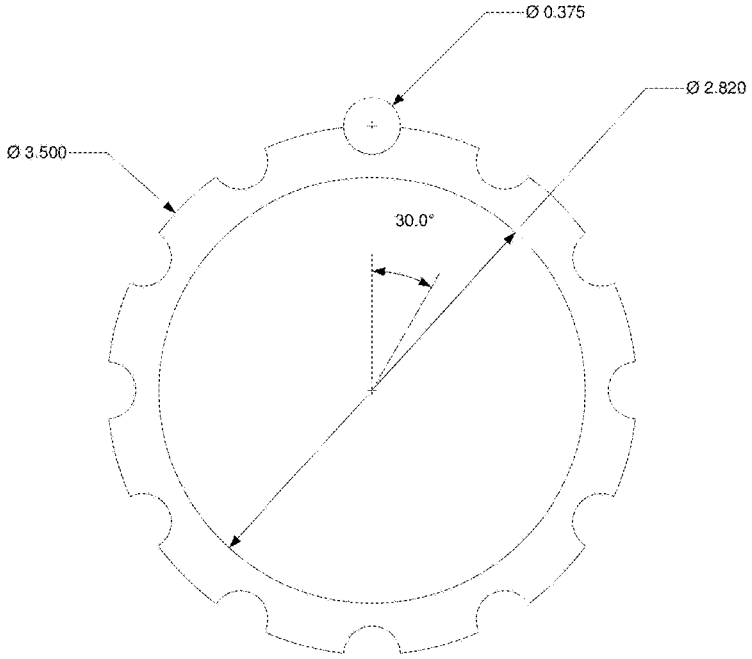
FIG. 5 shows a dimensioned cross-section of one instance of the inner pipe extrusion of the specially constructed integrated well screen, screen filter and extruded or grooved inner screen.

FIG. 5 shows a dimensioned cross-section of the inner pipe extrusion of the specially constructed integrated well screen 306. The dimensions are exemplary. The groves may be semicircular or equivalently formed in any convenient shape.

Figure 6:
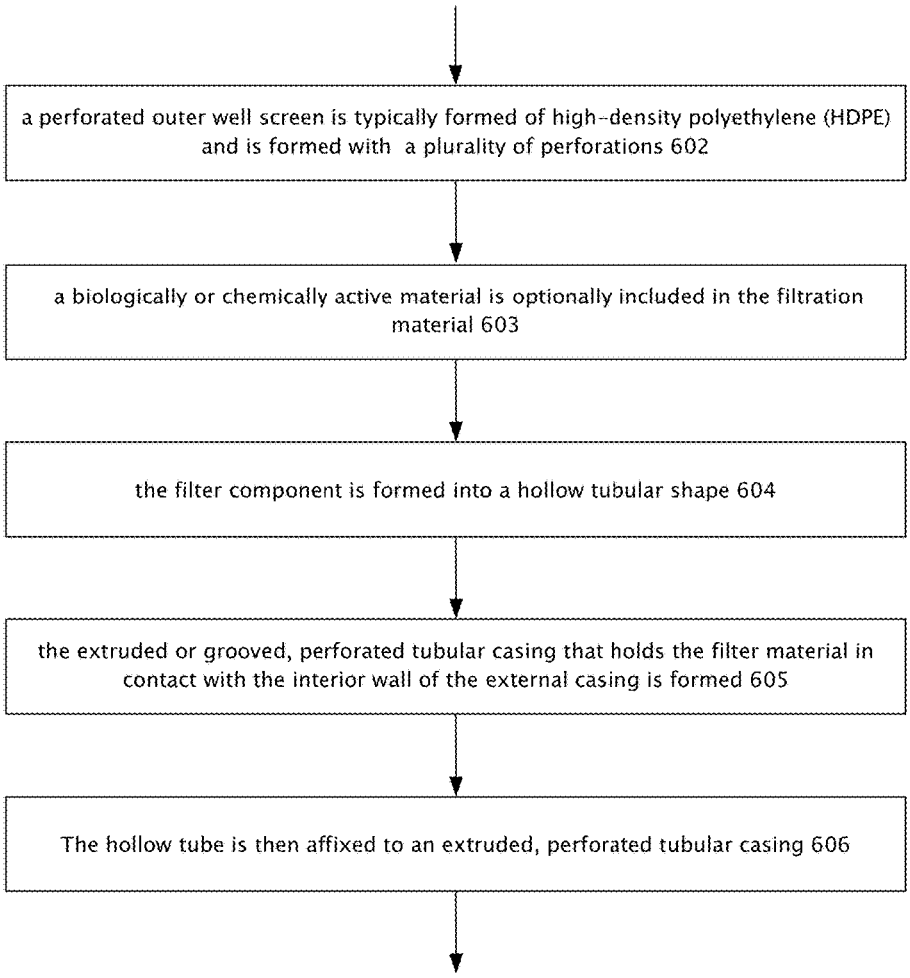
FIG. 6 is a block diagram of a process for constructing a specially constructed integrated well screen, screen filter and extruded or grooved inner screen.

FIG. 6 is a block diagram of a process for constructing a specially constructed integrated well screen, screen filter and extruded or grooved inner screen.

At block 602 a perforated outer well screen is typically formed of high-density polyethylene (HDPE) and is formed with a plurality of perforations to allow fluid communication between the inside of the well screen and the outside. The outer screen can be made of any suitable material, including steel, stainless steel, polyvinyl chloride (PVC), fiberglass, or other commonly used well casing materials. The well screen can be manufactured to any length by molding or cutting.

At block 604 the filter component is formed into a hollow tubular shape typically by sewing, however heat bonding is an alternate method. At block 606 this tube is then affixed to an extruded or grooved, perforated tubular casing that holds the filter material in contact with the interior wall of the external casing. The filter material is typically a non-woven geotextile with the filtration characteristics and chemical resistance properties required for the application, however other filtration materials can be used.

At block 605 the extruded or grooved, perforated tubular casing that holds the filter material in contact with the interior wall of the external casing is formed. In addition to supporting the filter material, the interior perforated tubular casing protects the filtration material from damage, promotes infiltration of water into the well screen, and eases the installation pumps, piping, and other down hole tooling during development and operation.

At block 603 in an alternative example, the filtration material is replaced by a biologically or chemically active material which is incorporated into sheets or is embedded or encapsulated in layers of geotextile. This material is incorporated into a tubular shape with similar size and shape to the filtration material described previously. The reactive material enables the well casing to be used in a passive treatment system for treatment of environmental contamination.

Figure 7:
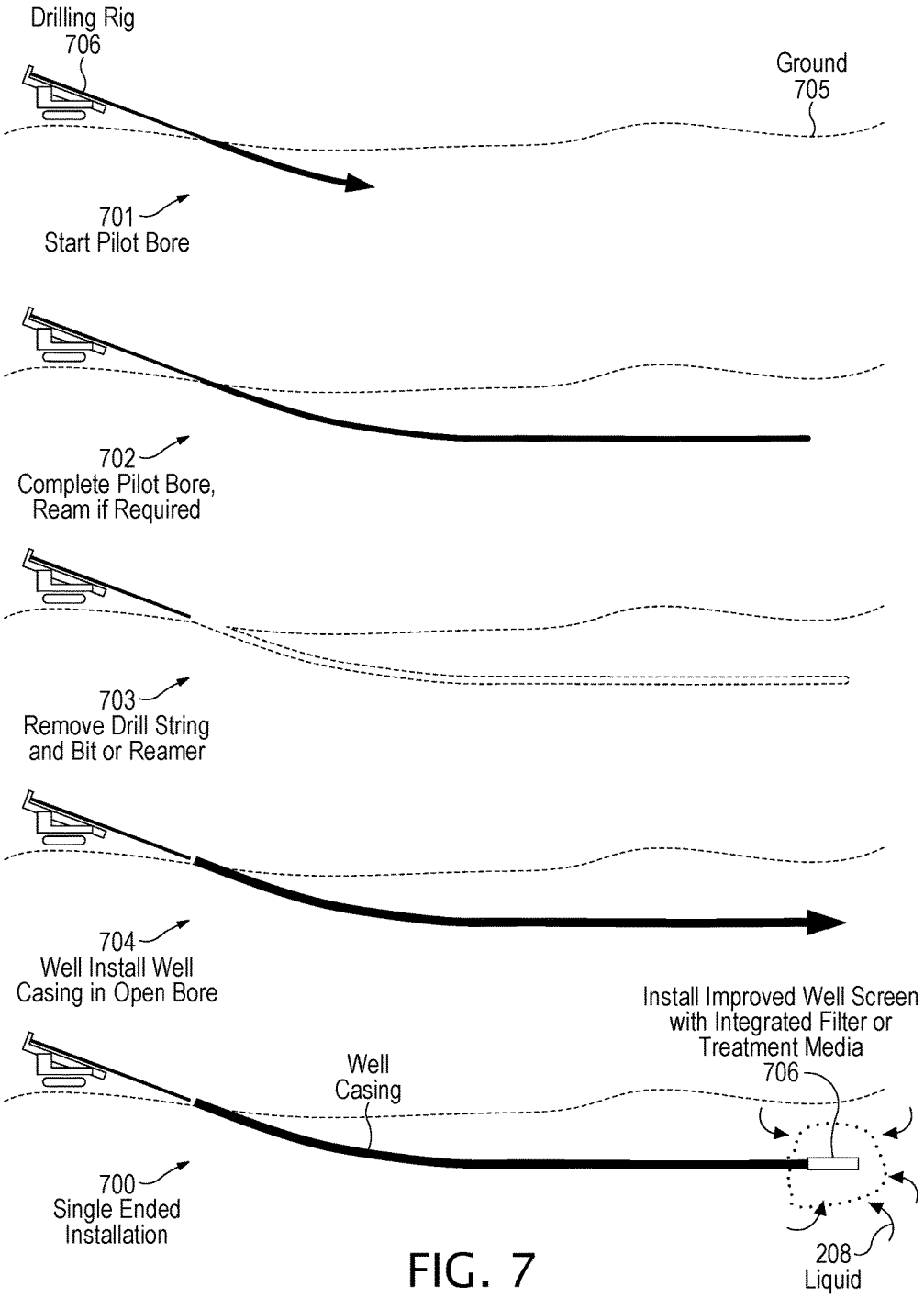
FIG. 7 shows the installation of a horizontal well including the specially constructed integrated well screen, screen filter and extruded or grooved inner screen.

FIG. 7 shows the installation of a horizontal well including the specially constructed integrated well screen, screen filter and extruded or grooved inner screen. Horizontal drilling and installing a well casing comprising an integral integrated well screen and screen filter may be provided in a standard single ended completion 700. The single ended completion drilling is shown at various stages of completion. In a type of horizontal directional drilling project called single-ended completion, or "blind" well completion the borehole may not exit the ground 705. Instead, the drilling rig 706, may start the pilot bore 701, with the bore drilled to some length without having exited the ground 705. After the pilot bore is complete. The bore hole may be reamed if needed 702. Next, the drilling tools that may include a drilling string or a reamer are removed from the borehole &03, and the well casing and screen are installed from the entry end 704. Such an installation procedure is similar to that for a conventional vertical well. This type of drilling may often be used for environmental projects.

Figure 8:
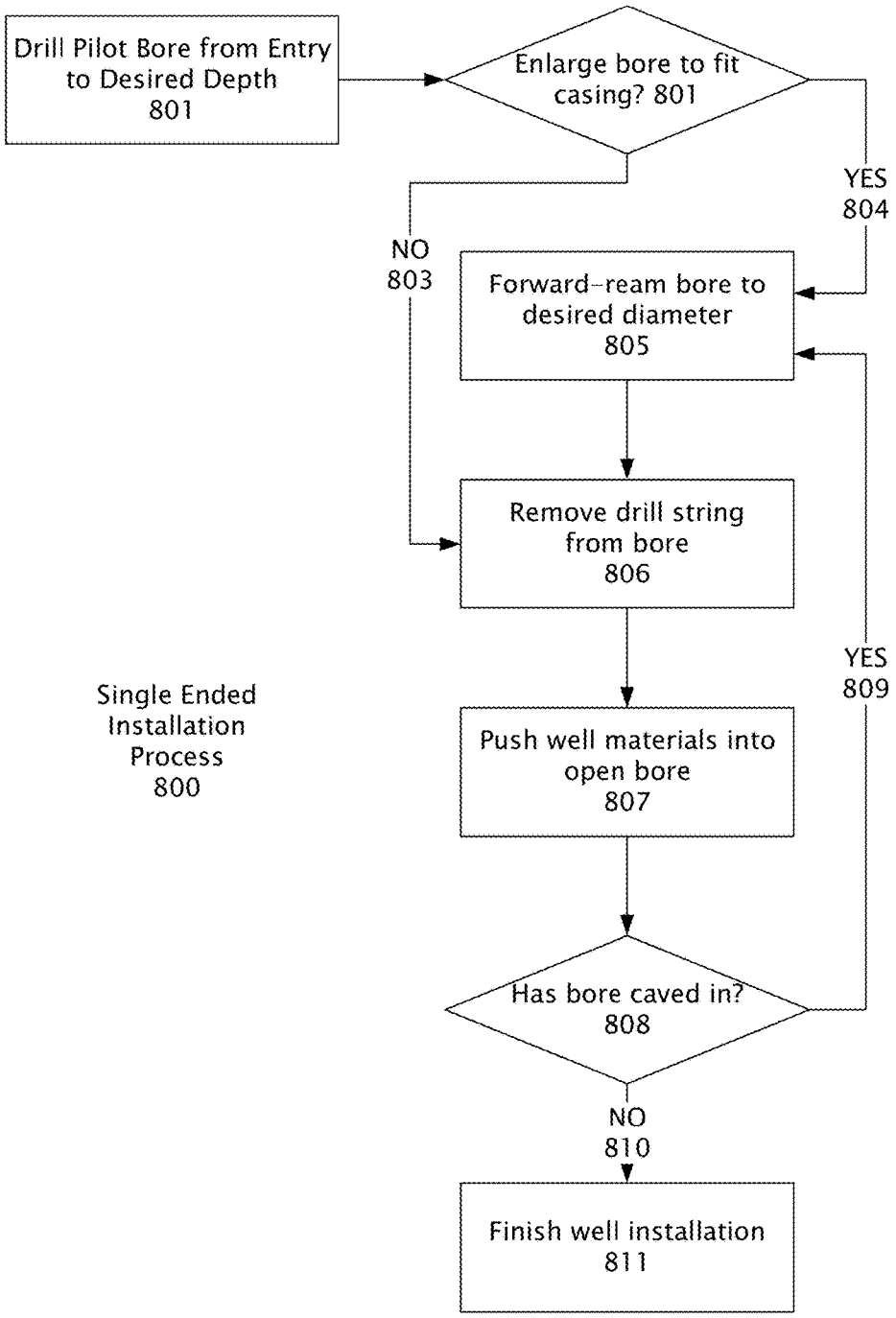
FIG. 8 shows a block diagram of a process for installing a horizontal well including the installation of the specially constructed integrated well screen, screen filter and extruded or grooved inner screen. and Like reference numerals are used to designate like parts in the accompanying drawings.

FIG. 8. shows a block diagram of a process for installing a horizontal well including the installation of the specially constructed integrated well screen, screen filter and extruded or grooved inner screen 800. First a pilot hole or bore may be drilled from an entry point to a desired depth 801. Next, after the bore reaches it desired depth it is determined if the bore needs to be enlarged to fit a casing being installed in the well 801. If the bore needs enlarging 804 the bore is forward reamed to a desired diameter 805. The sub process in block 806 is then executed.

Returning to block 801, if the bore does not 803 need to be enlarged to fit the casing, then the drilling string is removed from the bore 806. Well materials to be installed into the bore hole, are pushed in from the entry location. Occasionally during this process the bore hole might have caved in 808. If so 809, then the process returns to block 805, where it is repeated to open the closed bore. If not 810 then the well installation is finished 811.

Those skilled in the art will realize that the process sequences described above may be equivalently performed in any order to achieve a desired result. Also, sub-processes may typically be omitted as desired without taking away from the overall functionality of the processes described above.

The invention claimed is:

1. An integrated well screen assembly causing centering of a well screen in a sand pack present in a horizontal well comprising:

a tubular inner casing formed by extruding a generally tubular structure having an inner surface, and an outer surface, and of a given wall thickness the generally tubular structure also including:

a plurality of semicircular longitudinal groves formed on the outer surface of the generally tubular structure, in which a diameter of the semicircular grove is less than the given wall thickness; and a plurality of longitudinal apertures of a length, located about a circumference of the generally tubular structure and located in a bottom of a trough formed by each of the plurality of the semicircular longitudinal groves, each of the longitudinal apertures of the plurality of longitudinal apertures extending from the bottom of the trough to the inner surface, with a width of each of the longitudinal apertures being less than the diameter of the semicircular grove;

whereby extruded flow channels are formed; and whereby a thin inner support for the screen filter that is flexible and allows the well screen assembly to bend around corners in a well assembly, as the tubular inner casing has the form of a plurality of longitudinal support members for the screen filter, that are joined together at periodic intervals along a length of the tubular inner casing;

a screen filter including a tubular geotextile sock covering the exterior of the longitudinally grooved inner screen, the geotextile sock formed from a sheet of geotextile material forming a tube; and a perforated outer screen disposed over the screen filter.

2. The well screen assembly of claim 1, in which the geotextile sock includes at least one reactive material selected from a group consisting of activated carbon, zero valent iron nano particles, and micro-rilled ceramic beads.

3. The well screen assembly of claim 1, further comprising circumferential groves disposed into the inner screen.

4. The well screen assembly of claim 1, in which the geotextile is a filtration layer held in place by a pliable coarse mesh or lattice, made of high density polyethylene, to which the filtration layer is bonded.

5. The well screen assembly of claim 1, in which the longitudinal fluted groves are sized to prevent plugging of pore spaces in the geotextile material.

6. The well screen assembly of claim 1, in which the tubular geotextile sock is formed into a tube by heat sealing.

7. The well screen assembly of claim 1, in which the tubular geotextile sock is held in place on the longitudinally grooved inner screen by a friction fit.

8. The well screen assembly of claim 1, in which the longitudinally grooved inner screen is formed from high density polyethylene.

9. The well screen assembly of claim 1, in which the geotextile material is a filtration layer held in place by a pliable coarse mesh or lattice, made of high density polyethylene, to which the filtration layer is bonded, with the filtration layer infused with reactive materials selected from the group consisting of activated carbon, zero valent iron nano particles, and micro rilled ceramic beads.

10. The well screen assembly of claim 9, in which the reactive materials are sandwiched between two layers of geotextile.

11. The well screen assembly of claim 10, in which the two layers of geotextile are quilted.

12. The well screen assembly of claim 10, in which the two layers of geotextile are heat bonded.

13. The well screen assembly of claim 9, in which the reactive material is selected from the group consisting of prilled, granulated, and threads or the geotextile.

14. The well screen assembly of claim 1, in which the geotextile is non-woven.

15. The well screen assembly of claim 1, in which the geotextile is a fabric material selected from a group consisting of polyethylene and synthetic material, and the fabric material contains a plurality of pores.

16. The well screen assembly of claim 1, in which the screen material is a chemically active material which is incorporated into sheets.

17. The well screen assembly of claim 1, in which the geotextile is a filtration layer held in place by a pliable coarse mesh or lattice, made of high density polyethylene, to which the filtration layer is bonded.

18. An integrated well screen assembly causing centering of a well screen in a sand pack present in a horizontal well comprising:

a tubular inner casing formed by extruding a generally tubular structure having an inner surface, and an outer surface, and of a given wall thickness the generally tubular structure also including:

a plurality of longitudinal groves formed on the outer surface of the generally tubular structure, in which a width of a grove is less than the given wall thickness; and a plurality of longitudinal apertures of a length, located about a circumference of the generally tubular structure and located in a bottom of a trough formed by each of the plurality of the longitudinal groves, each of the longitudinal apertures of the plurality of longitudinal apertures extending from the bottom of the trough through to the inner surface, with a width of each of the longitudinal apertures being less than the width of the semicircular grove;

whereby extruded flow channels are formed; and whereby a thin inner support for the screen filter that is flexible and allows the well screen assembly to bend around corners in a well assembly, as the tubular inner casing has the form of a plurality of longitudinal support members for the screen filter, that are joined together at periodic intervals along a length of the tubular inner casing;

a screen filter including a fabric material selected from a group consisting of polyethylene and synthetic material, and the fabric material contains a plurality of openings covering the exterior of the longitudinally grooved inner screen; and a perforated outer screen disposed over the screen filter.

* * * * *